United States Patent [19]

Kitzen et al.

[11] Patent Number: 4,625,326

[45] Date of Patent: Nov. 25, 1986

[54] APPARATUS FOR GENERATING A PSEUDO-STEREO SIGNAL

[75] Inventors: Wilhelmus J. W. Kitzen; Mathias H. Geelen, both of Eindhoven, Netherlands

[73] Assignee: U.S. Philips Corporation, New York, N.Y.

[21] Appl. No.: 668,445

[22] Filed: Nov. 5, 1984

[30] Foreign Application Priority Data

Nov. 17, 1983 [NL] Netherlands ..... 8303945

[51] Int. Cl.[4] ..... H04R 5/00

[52] U.S. Cl. ..... 381/17; 381/63; 84/DIG. 26

[58] Field of Search ..... 381/18, 17, 62, 63; 84/DIG. 26, 1.25

[56] References Cited

U.S. PATENT DOCUMENTS

| | | | |
|---|---|---|---|
| 2,942,070 | 6/1960 | Hammond et al. | 381/63 |
| 3,110,771 | 11/1963 | Logan, Jr. et al. | 381/63 |
| 3,992,582 | 11/1976 | Osakabe | 381/63 |
| 4,181,820 | 1/1980 | Blesser et al. | 381/63 |
| 4,215,242 | 7/1980 | Gross | 381/63 |
| 4,268,717 | 5/1981 | Moore | 381/63 |
| 4,332,979 | 6/1982 | Fisher | 381/18 |
| 4,509,191 | 4/1985 | Miller | 381/18 |

*Primary Examiner*—Forester W. Isen

*Attorney, Agent, or Firm*—Thomas A. Briody; William J. Streeter; Marianne R. Rich

[57] ABSTRACT

An apparatus for generating a pseudo-stereo signal comprises at least two signal channels (3, 4), each signal channel (3) comprising a delay line (7) of which an output is fed back to the input (via $g_2$). The delay lines (7, 8) have tappings (12, 13 and 14, 15 respectively). The tappings (12, 14 and 13, 15 respectively) are coupled to inputs of two signal-combination units (18 and 19, respectively) whose outputs (20, 21) are coupled to two output terminals (22, 23) to supply the pseudo-stereo signal (FIG. 1).

6 Claims, 3 Drawing Figures

APPARATUS FOR GENERATING A PSEUDO-STEREO SIGNAL

BACKGROUND OF THE INVENTION

1. Field of the Invention

The invention relates to an apparatus for generating a pseudo-stereo signal.

2. Description of the Prior Art

Conventional apparatus comprises:

an input terminal for receiving a mono signal, at least two signal channels coupled to the input terminal, each signal channel comprising a delay line having an input and an output, the output being fed back to the input, and a first and a second signal-combination unit each having an output, which outputs are coupled to a first and a second output terminal, respectively, for supplying a first and a second output signal.

Such apparatus is disclosed in "A new approach to high speed digital signal processing based on microprogramming" by K. Sekiguchi, preprint No. 1841 (A-1) of the 70th Convention of the Audio Engineering Society, held from Oct. 30–Nov. 2, 1981 in New York. The known apparatus (see in particular FIG. 2) comprises eight signal channels each comprising a delay line in a feedback loop (also referred to as a comb filter), the outputs of the delay lines of the first four signal channels being coupled to an input of one signal-combination unit and the outputs of the delay lines of the other four signal channels being coupled to an input of the other signal-combination unit. The delays in the delay lines have been selected so that two signals with a low degree of correlation appear on the output terminals, which signals give the impression of a stereophonic signal.

The known apparatus has the disadvantage that it requires many components and, in particular, many delay lines in order to obtain the desired pseudo-stereo signal.

If such delay lines are constructed as charge-transfer devices, for example bucket-brigade or charge-coupled devices, or as shift registers, a comparatively large number of storage locations is required.

SUMMARY OF THE INVENTION

The invention aims at providing an apparatus which is also capable of generating a pseudo-stereo signal but which employs a substantially smaller number of components (in particular delay lines), so that a significant saving (of storage capacity) can be achieved.

According to the invention the apparatus is characterized in that the delay lines are each provided with first and second taps, the first taps of the delay lines are coupled to an input of the first signal-combination unit, the second taps of the delay lines are coupled to an input of the second signal-combination unit, and the first tap of each of at least two of said delay lines not coinciding with the second tap thereof. The invention is based on the recognition of the fact that the delay lines can be used several times, i.e. that two different signals can be taken from two different taps of one delay line, which signals each contribute to the signals constituting the pseudo-stereo signal.

The term "tap" is not to be understood to mean only an output of the delay line which is situated at a specific time interval from the input and the output of the delay line. The input and the output of a delay line may also be regarded as taps.

An apparatus in accordance with the invention comprises at least two signal channels each comprising one delay line. It is obvious that in the case of a larger number of parallel signal channels a better pseudo-stereo signal can be obtained. If only two signal channels are available, the first tap of each of the two delay lines does not coincide with the second tap thereof. If they were to coincide, identical signals would be obtained on the outputs of the two signal-combination units, which would not give the impression of a stereophonic signal.

In the case of more than two signal channels the first tap of the delay line of a signal channel may coincide with the second tap thereof. However, this is not advisable because such a signal channel will not contribute to an improvement of the pseudo-stereo signal.

It is to be noted that an apparatus is known from the publication "Natural sounding artificial reverberation" by M. R. Schroeder, see the Journal of the Audio Eng. Soc., July 1962, Vol. 10, No. 3, pages 219–223, in particular FIG. 7, which apparatus comprises four parallel signal channels, each signal channel comprising a comb filter C. However, all comb filters comprise two taps, the first tap of each delay line coinciding with the second tap thereof, and coinciding with the output of the delay line. The output signals of the delay lines are applied to a matrix circuit directly and after inversion, which circuit is not shown in more detail. If the output signals of the delay lines are fed directly to a first signal-combination unit and after inversion to a second signal-combination unit (which is not described in the publication), such an apparatus will become less suitable as an apparatus for generating a pseudo-stereo signal, because this apparatus will not be mono-compatible. More particularly, if the output signals of the two signal-combination units are added together this does not yield a mono signal but a signal which is equal to zero, which is highly undesirable.

An embodiment of the invention may be further characterized in that viewed in time the first taps of half the number of delay lines are situated before the second taps and, conversely, the second taps of the other delay lines are situated before the first taps if the number n of the signal channels is even, and viewed in time the first taps of $$\frac{n+1}{2}$$

of the delay lines are situated before the second taps and conversely the second taps of $$\frac{n-1}{2}$$

of the delay lines are situated before the first taps if the number n is odd. Thus, it is achieved that the reflections are as uniformly as possible distributed in time over the two output signals. If, viewed in time, all the first taps were situated before the associated second taps a signal applied to the input terminal would appear sooner on the first output terminal than on the second output terminal, which is of course undesirable. Therefore, it is ensured that viewed in time a number of first taps are situated before the second taps and a number of first taps are situated after the second taps, preferably about one half before and the other first taps after the associated second taps.

This or another embodiment of the invention may be further characterized in that the input and the output of each delay line constitute the two taps of the delay line. If the apparatus in accordance with the invention is to be constructed as an integrated circuit the available space on the substrate of the integrated circuit may necessitate an arrangement which is such that the delay lines are accommodated in a first integrated circuit and the other components of the apparatus in a second integrated circuit. As the number of interconnections that can be made between the two integrated circuits is limited, it may sometimes be necessary to employ the input and the output of the delay line, which already require two connections between the two integrated circuits, also as taps. If the tappings should not coincide with the input and the output of the delay line, each delay line would require four connections between the two integrated circuits. Thus, the available connections would soon be used up and it would be impossible to construct the apparatus in this manner.

A similar reasoning applies to an apparatus in accordance with the invention using digital technology. Such an apparatus will frequently employ serial signal (data) transmission over the connecting lines between the integrated circuits. In the case of such a data transmission the number of input and output operations (i/o operations) that can be performed within a specific time is limited. Therefore it is then also an advantage if only the input and output signals of the delay lines have to be transferred between the integrated circuits by means of i/o operations.

These or yet another embodiment of the invention, in which the input of at least one of the delay lines is one of the two taps of this delay line, may be further characterized in that an additional delay line is arranged between the input terminal and the signal channels. Suitably, the delay of the additional delay line is variable. In this way, in an embodiment in which the signal applied to the input terminal of the apparatus is also added without any delay to the output signals on the output terminals of the apparatus, the delay time of the first reflections in the reverberation provided by the apparatus and the delay time with which the reverberation occurs, are variable.

An embodiment of the invention which comprises six signal channels with associated delay lines, and in which the inputs of three of the six delay lines constitute the first taps of these delay lines and the inputs of the other three delay lines constitute the second taps of these delay lines, may be further characterized in that of said three first taps which are constituted by the inputs of the associated delay lines at least one tap is coupled to the first signal-combination unit via an inverting element and at least one tap is not coupled via an inverting element to said first signal-combination unit, and of said three second taps which are constituted by the inputs of the associated delay lines at least one tap is coupled to the second signal-combination unit via an inverting element and at least one tap is not coupled via an inverting element to said second signal-combination unit. If all three of the relevant first taps and all three of the relevant second tappings were coupled to the first and the second signal-combination unit respectively without (or conversely all three via) an inverting element, this would give rise to very strong first reflections on the two output terminals, which would sound very unnatural. By coupling at least one of the three to the relevant signal-combination unit via an inverting element and at least one of the three not via an inverting element, the signals from these two taps suppress each other more or less (depending on the values of the gain factors of any amplifiers attenuators arranged between the taps and the associated signal-combination unit), so that a more natural first reflection is left.

BRIEF DESCRIPTION OF THE DRAWING

The invention will now be described in more detail, by way of example, with reference to the drawings in which identical reference numerals refer to identical components. In the drawings.

DESCRIPTION OF THE PREFERRED EMBODIMENTS

Figure 1:
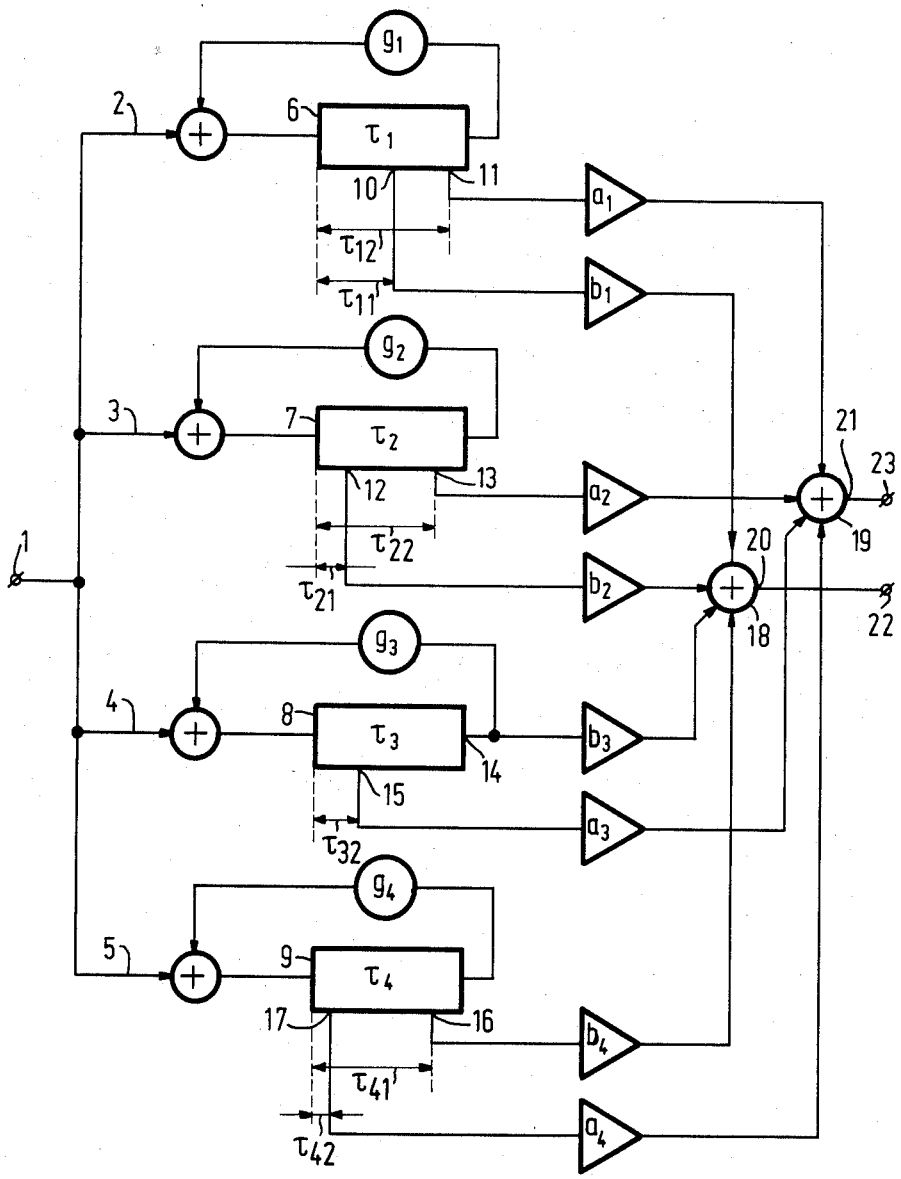
FIG. 1 shows an embodiment of the invention comprising four parallel signal channels.

FIG. 1 shows an embodiment comprising an input terminal 1 for receiving a monophonic signal which terminal is coupled to at least two, but in the present case four, signal channels 2 to 5. Each signal channel comprises a delay line 6 to 9 respectively. The outputs of the delay lines 6 to 9 are fed back to the associated inputs via the respective feedback networks $g_1$ to $g_4$. Such fedback delay lines are also referred to as comb filters. The delay lines 6 to 9 are each provided with a first and a second tap 10, 11; 12, 13, 14, 15 and 16, 17 respectively. The first taps 10, 12, 14 and 16 are coupled to an input of a first signal-combination unit 18 and the second taps 11, 13, 15 and 17 to a second signal-combination unit 19.

The outputs 20 and 21 of the first and the second signal-combination unit respectively are coupled to a first and a second output terminal 22 and 23 respectively for supplying a first and a second output signal constituting the pseudo-stereo signal. For two of the four delay lines, namely the delay lines 6 and 7, the first taps, 10 and 12 respectively, are situated in time before their associated second taps, 11 and 13 respectively. This means that a signal applied to the inputs of the delay lines 6 and 7 first appears on the taps 10 and 12 and at a later instant on the tappings 11 and 13 respectively, or $\tau_{11}<\tau_{12}$ and $\tau_{21}<\tau_{22}$. Viewed in time the second taps 15 and 17 of the other two delay lines are situated before the associated first taps 14 and 16 respectively, i.e. $\tau_{32}<\tau_3$ and $\tau_{42}<\tau_{41}$.

In more general terms, care will be taken that, viewed in time, not all the first taps are arranged before (or conversely after) the second taps, because otherwise the output signal on the first output terminal will be audible sooner (or conversely later) than the output signal on the second output terminal. This will sound very unnatural and is therefore undesirable. In general, a number of first taps will therefore be arranged before the associated second taps and the other first taps after the associated second taps, viewed in time.

Preferably, when the number n of signal channels is even, half the number of first taps are arranged before the second taps and the other half are arranged after the second taps (as shown in FIG. 1) and, when the number n is odd, the tappings are thus arranged for $$\frac{n+1}{2}$$

and $$\frac{n-1}{2}$$

delay lines respectively.

The delay values $\tau_1$, $\tau_2$, $\tau_3$ and $\tau_4$ of the delay lines preferably differ from each other. Further, whenever possible, care is taken that reflections appearing on a tap of a fedback delay line do not coincide with reflections appearing on a tap of another fedback delay line or on the other tap of the same delay line. As the frequency characteristic of a comb filter exhibits maxima at the specific frequencies of the comb filter care should be taken also that as few as possible (preferably no) resonant frequencies of the various comb filters coincide.

Preferably, the various delay times $\tau_{11}$, $\tau_{21}$, $\tau_{32}$, $\tau_{42}$ and the delay times $\tau_{12}$, $\tau_{22}$, $\tau_3$ and $\tau_{41}$ differ from each other.

Amplifier stages b are arranged in the connections from the first taps 10, 12, 14 and 16 to the first signal-combination unit 18, which stages amplify or attenuate the signals on the first taps by factors $b_1$ to $b_4$ respectively. If desired, one or more of the amplifier stages may invert the signal. Similarly, amplifier stages in the connections between the second taps and the second signal-combination unit 19 amplify or attenuate the signals by factors $a_1$ to $a_4$ respectively. For each of at least two of the delay lines the first tap does not coincide with the second tap thereof. For delay line 6 this means that $\tau_{11}$ is not equal to $\tau_{12}$ and for the delay line 7 that $\tau_{21}$ is not equal to $\tau_{22}$; $\tau_{11}$, $\tau_{12}$, $\tau_{21}$ and $\tau_{22}$ being the delay times required by a signal to appear on the relevant taps after having been applied to the input of a delay line (6 or 7). In the present embodiment each of all four delay lines comprises a first tap which does not coincide with the second tapping thereof. However, this is not essential. For example, the two taps of the delay line 9 may coincide. The signals which are then applied to the two signal-combination units via the amplifier stages $a_4$ and $b_4$ are then identical signals which do not contribute to a further improvement of the quality of the pseudo-stereo signal appearing on the output terminals 22, 23. Preferably, the two taps of a delay line therefore do not coincide.

The outputs of the delay lines may be used as taps. The first tap 14 of the delay line 8 is such a tap. The inputs of the delay lines may also be used as taps.

In some hardware versions of the apparatus in accordance with the invention, the four delay lines will be constructed as a first integrated circuit and the other components of the apparatus as a second integrated circuit because the entire apparatus cannot always be constructed as a single integrated circuit. The number of electrical connections between the two integrated circuits is often limited. Preferably, the inputs and the outputs of all the delay lines will then be used as the relevant first and second taps, thereby limiting the number of connections to eight.

A similar reasoning may be applied if the apparatus uses digital technology. As the signal (or data) transmission is then generally effected serially via a number of connections, it is often possible to reduce the number of connections. The time available for the transfer of a specific amount of data over one connection now imposes a limitation i.e. the number of input/output operations (i/o operations) is limited. Therefore, if the input and the output of a delay line are used as the two taps of the delay line the number of i/o operations for this delay line can be reduced by a factor of two.

Figure 2:
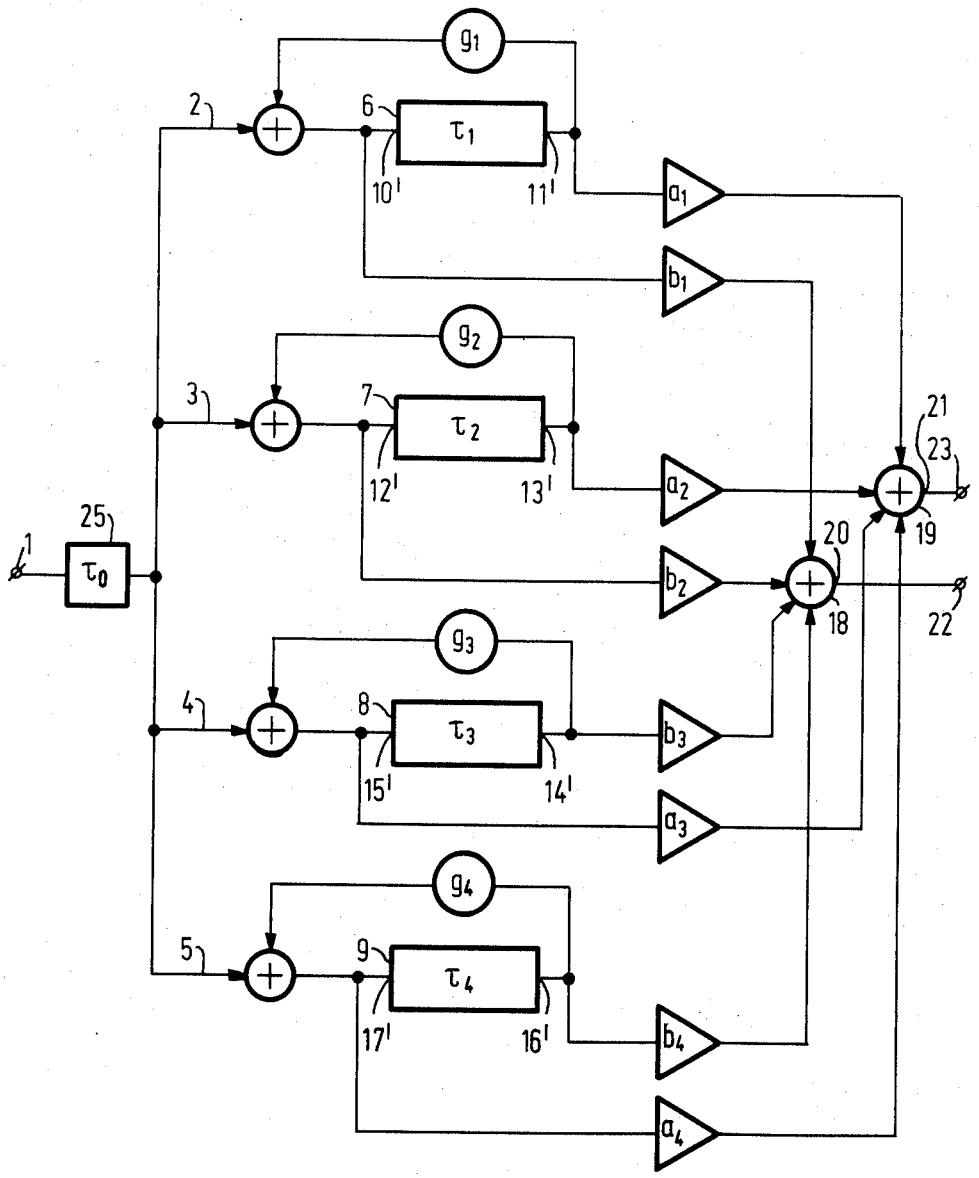
FIG. 2 shows another embodiment.

FIG. 2 shows an embodiment in which all the inputs and outputs of the delay lines also constitute the taps. Suitably, an additional delay line 25 will be arranged between the input terminal 1 and the parallel signal channels in FIG. 2, which delay line provides an additional time delay $\tau_o$. The delay time $\tau_o$ may be variable. Such an arrangement is particularly useful in a circuit in which the mono signal applied to the input terminal 1 is also added to the output signals on the output terminals 22 and 23. The circuit shown in FIG. 2 then provides reverberation, the first reflections appearing in the output signals after a time delay $\tau_o$. It will be appreciated that also in those cases in which one of the inputs of the delay lines constitute one of the two taps of the relevant delay line the additional delay line 25 should be utilized for the afore-mentioned purpose.

FIG. 2 clearly shows that this apparatus demands less storage capacity than the known apparatus described in preprint No. 1481. The corresponding known apparatus would comprise eight signal channels, each with a delay line having a delay of $\tau_o$, $\tau_o$, $\tau_o+\tau_1$, $\tau_o+\tau_2$, $\tau_o$, $\tau_o$, $\tau_o+\tau_3$ and $\tau_o+\tau_4$ respectively. This would require a total storage capacity of 8 $\tau_o+\tau_1+\tau_2+\tau_3+\tau_4$, whilst the apparatus of FIG. 2 requires only $\tau_o+\tau_1+\tau_2+\tau_3+\tau_4$.

The same applies to the arrangement shown in FIG. 1. If it is assumed that the taps 11, 13 and 16, just like the tapping 14, constitute the outputs of the delay lines, the total storage capacity in the apparatus shown in FIG. 1 is then $\tau_1+\tau_2+\tau_3+\tau_4$, whilst a corresponding known apparatus requires a storage capacity of $\tau_{11}+\tau_{21}+\tau_{32}+\tau_{42}+\tau_1+\tau_2+\tau_3+\tau_4$. The apparatus proposed here also require a smaller number of other components such as amplifiers/attenuators (or filters, see hereinafter). However, it is to be noted that although in the foregoing reference has been made to an apparatus as shown in FIG. 1 and FIG. 2 and "corresponding" known apparatus similar to the prior-art apparatus, the embodiments shown in FIG. 1 and FIG. 2 do not supply the same pseudo-stereo signal as the "corresponding" known apparatus.

The elements $g_1$ to $g_4$ in the feedback circuits in the two Figures may be attenuators which attenuate the signal by a certain factor, so that a reverberation with a specific reverberation time can be obtained. Alternatively, the relevant elements may be filters, so that a specific frequency-dependent reverberation can be obtained. It is obvious that if the apparatus is of the digital type the filters must be digital filters.

Figure 3:
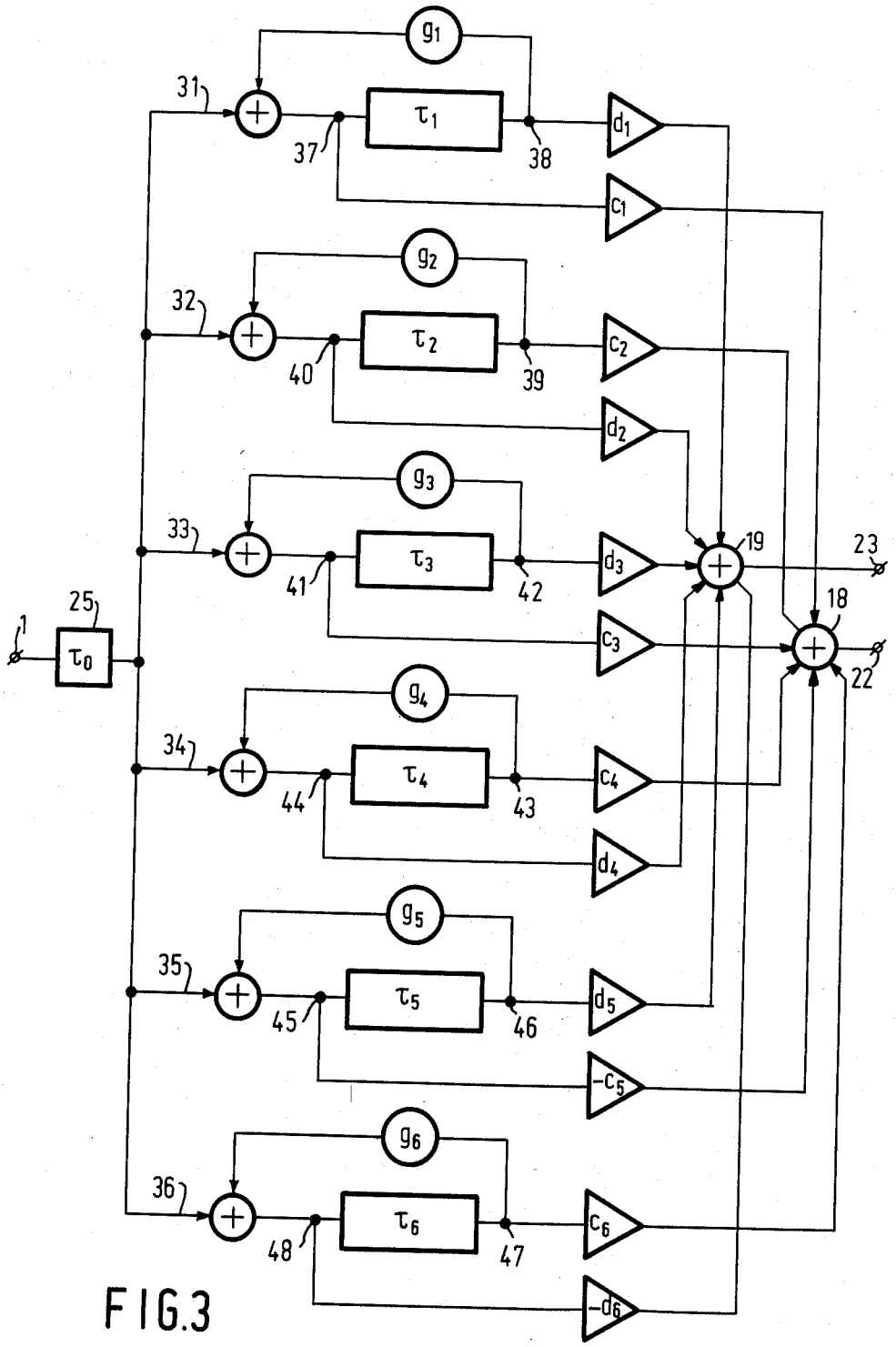
FIG. 3 shows yet another embodiment comprising six parallel signal channels.

FIG. 3 shows an embodiment comprising six signal channels 31 to 36 and six associated fedback delay lines $\tau_1$ to $\tau_6$.

The inputs of the delay lines $\tau_1$, $\tau_3$ and $\tau_5$ constitute the first taps 37, 41 and 45 respectively, which are coupled to an input of the first signal-combination unit 18 via amplifiers-attenuators $c_1$, $c_3$ and $-c_5$ respectively. The outputs of the delay lines $\tau_2$, $\tau_4$ and $\tau_6$ constitute the first tappings 39, 43 and 47 respectively, which are coupled to an input of the first signal-combination unit via amplifiers/attenuators $c_2$, $c_4$ and $c_6$ respectively. The outputs of the delay lines $\tau_1$, $\tau_3$ and $\tau_5$ constitute the second tappings 38, 42 and 46 respectively, which are coupled to an input of the second signal-combination unit 19 via amplifiers/attenuators $d_1$, $d_3$ and $d_5$ respectively. The inputs of the delay lines $\tau_2$, $\tau_4$ and $\tau_6$ constitute the second tappings 40, 44 and 48 respectively, which are coupled to an input of the second signal-combination unit 19 via amplifiers/attenuators $d_2$, $d_4$ and $-d_6$ respectively.

The signs of the factors $c_1$, $c_3$ and $-c_5$ are not all the same (positive or negative). The same applies to the factors $d_2$, $d_4$ and $-d_6$.

Since the signal from tap 45 is applied to the first signal-combination unit 18 in phase opposition to the signals from taps 41 and 37 owing to the signal inversion in the amplifiers/attenuators $-c_5$, which in the present case functions as an inverting element, the signals which first reach the output terminal 22 via the delay line 25 and the first taps 37, 41 and 45 will be suppressed completely or partly. This is desirable in order to ensure that the amplitudes of said signals which first reach the output terminal 22 (which signals are also referred to as first reflections) are not too high. It is obvious that the same applies to the three signals from the second taps 40, 44 and 48.

An excessive amplitude for these first reflections, which would arise if the signals from taps 37, 41, 45 and 40, 44, 48 respectively were applied in phase to the first and the second signal-combination unit respectively, results in a very unnatural effect on the output signal of the apparatus, so that it is not possible to obtain a satisfactory pseudo-stereo signal.

It is to be noted that the scope of the invention is not limited to the embodiments as shown in the Figures. The invention also relates to apparatus which differs from the embodiments shown with respect to points which do not relate to the inventive idea as defined by the claims.

What is claimed is:

1. An apparatus for generating a pseudo-stereo signal, which apparatus comprises:

an input terminal for receiving a mono signal, at least two signal channels, each comprising a delay line, coupled to the input terminal, each delay line having an input and an output, the output being fed back to the input, and a first and a second signal-combination unit, each having an output, which outputs are coupled to a first and a second output terminal respectively, for supplying a first and a second output signal, characterized in that the delay lines are each provided with first and second taps, the first tappings of the delay lines are coupled to an input of the first signal-combination unit, the second taps of the delay lines are coupled to an input of the second signal-combination unit, and the first tap of each of at least two of said delay lines not coinciding with the second tap thereof.

2. An apparatus as claimed in claim 1, characterized in that viewed in time the first taps of half the number of the delay lines are situated before the second taps and, conversely, the second taps of the other delay lines are situated before the first taps if the number n of said signal channels is even and viewed in time the first tappings of $$\frac{n+1}{2}$$

of the delay lines are situated before the second tappings and, conversely, the second tappings of $$\frac{n-1}{2}$$

of the delay lines are situated before the first tappings if the number n is odd.

3. An apparatus as claimed in claim 1 or 2, characterized in that the input and the output of each delay line constitute the two taps of the delay line.

4. An apparatus as claimed in claim 1, the input of at least one of said delay lines being one of the two taps of that delay line, characterized in that an additional delay line is arranged between the input terminal and the signal channels.

5. An apparatus as claimed in claim 4, characterized in that the delay of the additional delay line is variable.

6. An apparatus as claimed in claim 2, comprising six signal channels with associated delay lines, the inputs of three of the six delay lines constituting the first taps of these delay lines and the inputs of the other three delay lines constituting the second taps of these delay lines, characterized in that of said three first taps which are constituted by the inputs of the associated delay lines at least one tap is coupled to the first signal-combination unit via an inverting element and at least one tap is not coupled via an inverting element to said first signal-combination unit, and of said three second taps which are constituted by the inputs of the associated delay lines at least one tap is coupled to the second signal-combination unit via an inverting element and at least one tap is not coupled via an inverting element to said second signal-combination unit.

* * * * *